US005972589A

United States Patent [19]

Breslav et al.

[11] Patent Number: 5,972,589

[45] Date of Patent: Oct. 26, 1999

[54] SILVER HALIDE EMULSION MANUFACTURING METHOD

[75] Inventors: Jouri Breslav, Moskow, Russian Federation; Maria Stella Garozzo, Savona, Italy

[73] Assignee: Imation Corporation, St. Paul, Minn.

[21] Appl. No.: 08/955,828

[22] Filed: Oct. 22, 1997

[30] Foreign Application Priority Data

Nov. 13, 1996 [EP] European Pat. Off. ..... 96118178

[51] Int. Cl.[6] ..... G03C 1/08; G03C 1/09; G03C 1/035; G03C 1/34

[52] U.S. Cl. ..... 430/569; 430/568; 430/599; 430/603; 430/607; 430/613; 430/615

[58] Field of Search ..... 430/603, 599, 430/569, 607, 613, 615, 966, 568

[56] References Cited

U.S. PATENT DOCUMENTS

| | | | |
|---|---|---|---|
| 4,078,937 | 3/1978 | Tani et al. | 430/568 |
| 4,610,958 | 9/1986 | Matsuzaka et al. | 430/567 |
| 5,061,614 | 10/1991 | Takada et al. | 430/569 |
| 5,079,138 | 1/1992 | Takada | 430/567 |
| 5,114,838 | 5/1992 | Yamada | 430/569 |
| 5,254,456 | 10/1993 | Yamashita et al. | 430/611 |
| 5,290,673 | 3/1994 | Nishikawa | 430/567 |
| 5,368,999 | 11/1994 | Makino | 430/569 |

FOREIGN PATENT DOCUMENTS

| | | | |
|---|---|---|---|
| 0 407 576 A1 | 7/1989 | European Pat. Off. | G03C 1/015 |
| 404142 | 12/1990 | European Pat. Off. | G03C 1/09 |
| 0 434 012 A1 | 6/1991 | European Pat. Off. | G03C 1/035 |
| 0 435 270 A1 | 7/1991 | European Pat. Off. | G03C 1/10 |
| 0 438 791 A1 | 7/1991 | European Pat. Off. | G03C 1/10 |
| 0 552 650 A1 | 7/1993 | European Pat. Off. | G03C 1/08 |

*Primary Examiner*—Mark F. Huff
*Attorney, Agent, or Firm*—Paul B. Simboli

[57] ABSTRACT

The present invention relates to a method for manufacturing a silver halide photographic emulsion comprising a nucleation step, a growing step and a washing step, wherein a reduction sensitization is performed between said growing step and said washing step in the presence of a sulfuring agent and a stabilizer. According to a preferred embodiment a fine grain silver halide emulsion is added either between the addition of stabilizer and the addition of sulfuring agent or between the addition of sulfuring agent and the start of reduction sensitization or both.

24 Claims, No Drawings

SILVER HALIDE EMULSION MANUFACTURING METHOD

FIELD OF THE INVENTION

The present invention relates to a manufacturing method for preparing a silver halide emulsion having a high sensitivity without adversely affecting the fog of the photographic silver halide emulsion and having an excellent storage stability. In particular, the present invention relates to the manufacture of a silver halide emulsion by performing reduction and sulfur sensitization in the presence of an azaindene stabilizer.

BACKGROUND OF THE INVENTION

In the photographic field, there is a continuous demands to obtain silver halide photographic emulsions having lower fog and better speed and stability under storage condition.

It is well known in the art that speed and fog of a silver halide photographic emulsion are dependent upon each other and it is difficult to increase speed without a corresponding increase in fog and vice versa.

Sensitivity of a silver halide photographic emulsion can be improved by (1) increasing the number of photons absorbed by each silver halide grain, (2) increasing the conversion efficiency of photoelectrons generated by light absorption into silver clusters, or (3) improving the development activity to have a complete development of silver clusters.

A practical way to increase the number of photons absorbed by each silver halide grain is by increasing the grain size and having a high concentration of sensitizing dye absorbed on the surface of the silver halide grains. However, this method reduces the image quality. Moreover, high concentration of sensitizing dyes can have an adverse effect on the sensitivity of the silver halide grains due to the tendency for recombination of trapped photoelectrons with free dye photoholes and destruction of the latent image (silver clusters).

The improvement of developing activity has the drawback of adversely affecting graininess of the resulting image.

Increasing the conversion efficiency of photoelectrons generated by light absorption into silver clusters is one means of reducing the effects which decrease the probability of recombination of photoelectrons and positive holes generated by light absorption.

It is known in the art that reduction sensitization methods in which a reducing agent is introduced into the vessel during silver halide preparation can effectively reduce the recombination by formation of fine silver cluster ($Ag_2$) having no development activity in the interior of the silver halide grains or on the surface thereof. It is also known in the art to form molecular clusters of $Ag_2S$ (very effective photohole acceptors) by introducing sulfur compounds during silver halide preparation.

Examples of these techniques can be found in EP 435,270; EP 371,338; U.S. Pat. No. 5,254,456; U.S. Pat. No. 5,079,138; U.S. Pat. No. 5,368,999; EP 438,791; EP 434,012; U.S. Pat. No. 5,290,673; U.S. Pat. No. 5,061,614; EP 552,650; and EP 407,576.

EP 435,270 and EP 434,012 disclose the use of oxidizing agents during silver halide emulsion making (in particular, the use of thiosulfonate derivatives).

EP 371,338 and U.S. Pat. No. 5,061,614 disclose a silver halide emulsion reduction sensitized with a reducing agent in the presence of a thiosulfonic acid derivative during precipitation of silver halide grains.

U.S. Pat. No. 5,254,456 and U.S. Pat. No. 5,079,138 disclose a silver halide emulsion reduction sensitized with ascorbic acid or derivatives thereof (in an amount of from $10^{-1}$ to $10^{-5}$ mol/molAg) in the presence of a thiosulfonic acid derivative during precipitation of silver halide grains.

U.S. Pat. No. 5,368,999 discloses a silver halide emulsion reduction sensitized during precipitation of silver halide grains and then added with a thiosulfonic acid derivative.

EP 438,791 discloses the use of a thiosulfonic acid derivative during manufacturing of a silver halide tabular emulsion containing not less than 3% of silver iodide.

U.S. Pat. No. 5,290,673 discloses a silver halide emulsion reduction sensitized with ascorbic acid or derivatives thereof (in an amount of from $10^{-1}$ to $10^{-5}$ mol/molAg) during precipitation of silver halide grains and further added with a mercaptotetrazole derivative.

EP 552,650 discloses a reduction sensitized silver halide emulsion further containing a polyvalent metal (such as Fe, Ir, Cd, Pb, In, Os, and Re) in an amount of not less than $10^{-6}$ mol/molAg.

EP 407,576 discloses a silver halide emulsion reduction sensitized in the presence of an oxidizing agent, said silver halide emulsion being prepared by adding fine silver halide grains into a reaction vessel for causing nucleation and/or growing of silver halide grains.

However, the above mentioned technique still requires an improvement for the prevention of the surface molecular cluster aggregation and formation of polyatomic Agn and polymolecular $(Ag_2S)n$ (wherein n is higher than 2), which decrease speed and increase fog.

U.S. Pat. No. 5,114,838 discloses the use of azaindene derivatives in a manufacturing process of a silver halide emulsion subjected to reduction sensitization, preferably in the presence of a thiosulfonic acid derivative. However, the azaindene derivative is added after reduction sensitization and together with or before chemical sensitization.

U.S. Pat. No. 4,610,958 discloses the use of a tetraazaindene derivative in the process of manufacturing monodispersed octahedral or tetradecahedral silver bromoiodide emulsions.

U.S. Pat. No. 4,078,937 discloses the use of tetraazaindene derivatives in the process of manufacturing a sulfur sensitized ammoniacal silver halide emulsion having grain size not exceeding 0.5 $\mu$m.

SUMMARY OF THE INVENTION

The present invention provides a method for manufacturing a silver halide photographic emulsion comprising a nucleation step, a growing step and a washing step, wherein a reduction sensitization is performed between the growing step and the washing step in the presence of a sulfuring agent and a stabilizer.

Preferably, the reduction sensitization is performed by ascorbic acid or derivatives thereof, the sulfuring agents are selected from the group consisting of thiosulfonic acid and derivatives thereof and the stabilizers are selected from the group consisting of azaindene derivatives. Preferably, a fine grain silver halide emulsion is added either between the addition of stabilizer and the addition of sulfuring agent, or between the addition of sulfuring agent and the start of reduction sensitization, or both.

In another embodiment of the present invention, a silver halide radiographic element is provided comprising a support and at least one silver halide emulsion layer coated on both sides thereof, wherein said silver halide emulsion layer comprises a silver halide emulsion manufactured according to the above described method, and wherein said silver halide radiographic element shows a Dmin and speed variation lower than 10% when stored for 5 days at 50° C. and 60% relative humidity.

DETAILED DESCRIPTION OF THE INVENTION

The manufacturing process of silver halide elements usually comprises an emulsion making step, a chemical and optical sensitization step, and a coating step. The silver halide emulsion making step generally comprises a nucleation step, in which silver halide grain seeds are formed, followed by one or more growing steps, in which the grain seeds achieve their final dimension, and a washing step, in which all soluble salts are removed from the final emulsion. A ripening step is usually performed between the nucleation and growing step and/or between the growing and the washing steps.

Silver halide emulsions can be prepared using a single-jet method, a double-jet method, or a combination of these methods and can be ripened using, for instance, an ammonia method, a neutralization method, or an acid method. Features which may be adjusted to control grain growth include pH, pAg, temperature, shape and size of reaction vessel, and the reaction method (e.g., accelerated or constant flow rate precipitation, interrupted precipitation, ultrafiltration during precipitation, reverse mixing process and combinations thereof). A silver halide solvent, such as ammonia, thioethers, thioureas, etc., may be used, if desired, for controlling grain size, form of the grains, particle size distribution of the grains, and the grain-growth rate. The term "silver halide solvent" as employed herein means a solubilizing agent for silver halide. References can be found in Trivelli and Smith, *The Photographic Journal*, Vol. LXXIX. May 1939, pp. 330–338; T. H. James, The Theory of The Photographic Process, 4th Edition, Chapter 3; *Chimie et Physique Photographique*, P. Glafkides, Paul Montel (1967); *Photographic Emulsion Chemistry*, G. F. Duffin, The Focal Press (1966); *Making and Coating Photographic Emulsion*, V. L. Zelikman, The Focal Press (1966); U.S. Pat. Nos. 2,222,264; 2,592,250; 3,650,757; 3,917,485; 3,790, 387; 3,716,276; 3,979,213; and Research Disclosure, September 1994, Item 36544 "Photographic Silver Halide Emulsions, Preparations, Addenda, Systems and Processing".

Commonly employed halogen compositions of the silver halide grains can be used in the preparation of the silver halide emulsion. Suitable silver halides include silver chloride, silver bromide, silver iodide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol% silver iodide, preferably from 0.2 to 5 mol % silver iodide, and more preferably from 0.5 to 1.5% mol silver iodide. The halogen composition of individual grains may be homogeneous or heterogeneous.

The grains of these silver halide emulsions may be coarse or fine, and the grain size distribution may be narrow or broad. In addition, the silver halide grains may be regular grains having a regular crystal structure such as cube, octahedron, and tetradecahedron, or the spherical or irregular crystal structure, or those having crystal defects such as twin planes, or those having a tabular form, or combination thereof. Furthermore, the grain structure of the silver halides may be uniform from the interior to exterior thereof, or be multilayer. According to a simple embodiment, the grains may comprise a core and a shell, which may have different halide compositions and/or may have undergone different modifications such as the addition of doping agents. Besides having a differently composed core and shell, the silver halide grains may also comprise different phases in-between. Furthermore, the silver halides may be of such a type as allows a latent image to be formed mainly on the surface thereof or such a type as allows it to be formed inside the grains.

Tabular silver halide emulsions are preferably employed in the process of the present invention.

Tabular silver halide emulsions are characterized by the average diameter:thickness ratio of silver halide grains (often referred to in the art as aspect ratio). Tabular silver halide having an aspect ratio of at least 2:1, preferably 2:1 to 20:1, more preferably 2:1 to 14:1, and most preferably 2:1 to 8:1 are used in the process of the present invention. Suitable average diameters of the tabular silver halide grains range from about 0.3 to about 5 $\mu$m, preferably 0.5 to 3 $\mu$m, more preferably 0.8 to 1.5 $\mu$m. Suitable tabular silver halide grains have a thickness of less than 0.4 $\mu$m, preferably less than 0.3 $\mu$m and more preferably within 0.1 to 0.3 $\mu$m. The projected area of the tabular silver halide grains accounts for at least 50%, preferably at least 80% and more preferably at least 90% of the projected area of all the silver halide grains of the emulsion.

The tabular silver halide grain dimensions and characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the method used, the average diameter:thickness ratios obtained do not greatly differ.

Silver halide emulsions containing tabular silver halide grains can be prepared by various processes known for the preparation of photographic elements.

Preparation of silver halide emulsions containing tabular silver halide grains is described in, for example, de Cugnac and Chateau, "Evolution of the Morphology of Silver Bromide Crystals During Physical Ripening", *Science and Industries Photographiques*, Vol. 33, No. 2 (1962), pp. 121–125; Gutoff, "Nucleation and Growth Rates During the Precipitation of Silver Halide Photographic Emulsions", *Photographic Science and Engineering*, Vol. 14, No. 4 (1970), pp. 248–257; Berry et al., "Effects of Environment on the Growth of Silver Bromide Microcrystals", Vol. 5, No. 6 (1961), pp. 332–336; *Research Disclosure*, September 1994, Item 36544 "Photographic Silver Halide Emulsions, Preparations, Addenda, Systems and Processing"; U.S. Pat. Nos. 4,063,951; 4,067,739; 4,184,878; 4,434,226; 4,414, 310; 4,386,156; 4,414,306 and EP 263,508.

The silver halide emulsion prepared according to the above mentioned techniques is then subjected to the process of the present invention by performing reduction sensitization in the presence of a sulfuring agent and a stabilizer. The term "performing reduction sensitization in the presence of a sulfuring agent and a stabilizer" means that both the sulfuring agent and the stabilizer are added before the starting of the reduction sensitization. Preferably, the stabilizer is added before the sulfuring agent. Reduction sensitization is preferably conducted between the end of the growing step and the start of the washing step. The pAg of the vessel emulsion during the addition of the compounds is preferably in the range from 6 to 14, more preferably from 8 to 12, and most preferably from 9 to 10.

Suitable stabilizers include azaindene derivatives, such as, diazaindenes, triazaindenes, tetraazaindenes and pentaazaindenes. Tetraazaindes are preferred, and tetraazaindens substituted with at least one hydroxy group are more preferred. Tetraazaindenes useful in the present invention can have one or more organic substituents in addition to hydroxy group, such as, alkyl group, alkylthio group, halogen group, amino group, sulfo group, carboxy group, and the like.

Particularly preferred tetraazaindene compounds include, but are not limited to, the compounds listed in the following table A.

TABLE A

| | |
|---|---|
| (1) | 4-Hydroxy-6 methyl-,1,3,3a,7-tetraazaindene |
| (2) | 4-Hydroxy-1,3,3a,7-tetraazaindene |
| (3) | 4-Hydroxy-6-phenyl-1,3,3a,7-tetraazaindene |
| (4) | 4-Methyl-6-hydroxy,-1,3,3a,7-tetraazaindene |
| (5) | 2,6-Dimethyl-4-hydroxy-1,3,3a,7-tetraazaindene |
| (6) | 4-Hydroxy-5-ethyl-6-methyl-1,3,3a,7-tetraazaindene |
| (7) | 2,6-Dimethyl-4-hydroxy-S-ethyl-1,3,3a,7-tetraazaindene |
| (8) | 4-Hydroxy-5,6-dimethyl-1,3,3a,7-tetraazaindene |
| (9) | 2,5,6-Trimethyl-4-hydroxy-1,3,3a,7-tetraazaindene |
| (10) | 2-Methyl-4-hydroxy-6-phenyl-1,3,3a,7-tetraazaindene |
| (11) | 4-Hydroxy-6-methyl-1,2,3a,7-tetraazaindene |
| (12) | 4-Hydroxy-6-ethyl-1,2,3a,7,tetraazaindene |
| (13) | 4-Hydroxy-6-phenyl-1,2,3a,7-tetraazaindene |
| (14) | 4-Hydroxy-1,2,3a,7-tetraazaindene |
| (15) | 4-Methyl-6-hydroxy-1,2,3a,7-tetraazaindene |

The stabilizer is added to the silver halide emulsion in an amount preferably ranging from $10^{-6}$ to $10^{-1}$ mol per mole of silver, more preferably from $10^{-4}$ to $10^{-2}$ mol per mole of silver, and still more preferably from $5\times10^{-3}$ to $5\times10^{-2}$.

Preferred sulfuring agents are thiosulfonic acid or derivatives thereof and are represented by the following general formulas (1) to (3).

$$R—SO_2S—M \quad (1)$$

$$R—SO_2S—R^1 \quad (2)$$

$$R—SO_2S—L_m—SSO_2—R^2 \quad (3)$$

wherein R, $R^1$, and $R^2$, represents an aliphatic group, an aromatic group, or a heterocyclic group, M represents a cation, L represents an organic divalent linking group, m is 0 or 1. R, $R^1$, and $R^2$ may be the same or different groups.

When R, $R^1$, and $R^2$ each represents an aliphatic group, the aliphatic group is preferably a saturated or unsaturated, straight-chain, branched or cyclic aliphatic hydrocarbon group wherein the alkyl group has 1 to 22 carbon atoms or alkenyl or alkinyl groups have 2 to 22 carbon atoms. These groups can have a substituent group. Examples of the alkyl groups include methyl, ethyl, propyl, butyl, pentyl, hexyl, octyl. 2-ethylhexyl, decyl, dodecyl, hexadecyl, octadecyl, cyclohexyl, isopropyl, and t-butyl. Examples of the alkenyl groups include allyl and butenyl. Examples of the alkinyl groups include propargyl and butynyl.

An aromatic group of R, $R^1$, and $R^2$ includes aromatic groups of single-ring or condensed-ring and preferably has 6 to 20 carbon atoms. Examples of such an aromatic group are phenyl and naphthyl. These groups can have substituent group.

A heterocyclic group of R, $R^1$, and $R^2$ includes a 3- to 15-membered ring having at least one element of nitrogen, oxygen, sulfur, selenium, and tellurium and at least one carbon atom, preferably, a 3- to 6-membered ring. Examples of heterocyclic groups include pyrrolidine, piperidine, pyridine, tetrahydrofurane, thiophene, oxazole, thiazole, imidazole, benzothiazole, benzoxazole, benzimidazole, selenazole, benzoselenazole, tellurazole, triazole, benzodiazole, tetrazole, oxadiazole, and thiadiazole.

Examples of substituent groups which may be present on R, $R^1$, and $R^2$ include an alkyl group (e.g., methyl, ethyl, and hexyl), an alkoxy group (e.g., methoxy, ethoxy, and octyloxy), an aryl group (e.g., phenyl, naphthyl, and tolyl), a hydroxyl group, a halogen atom (e.g., fluorine, chlorine, bromine, and iodine), an aryloxy group (e.g. phenoxy), an alkylthio group (e.g., methylthio and butylthio), an arylthio group (e.g. phenylthio), an acyl group (e.g. acetyl, propionyl, butyryl, and valeryl), a sulfonyl group (e.g. methyl sulfonyl and phenylsulfonyl), an acylamino group (e.g., acetylamino and benzoylamino), a sulfonylamino group (e.g., methanesulfonylamino group and benzenesulfonylamino), an acyloxy group (e.g., acetoxy and benzoxy), carboxyl, cyano, sulfo amino, $—SO_2SM$ (M represent a monovalent cation), and $—SO_2R^1$.

A divalent bonding group represented by L includes an atom or an atom group containing at least one of C, N, S. and 0. Examples of L include alkylene, alkenylene, alkynylene, arylene, —O—, —S—, —NH—, —CO—, and $—SO_2—$. These divalent group can be used singly or in a combination of two or more thereof. Preferably L represents a divalent aliphatic group or a divalent aromatic group. Examples of the divalent aliphatic of L include $—(CH_2)n—$(wherein n is 1 to 12), $—CH_2—CH{=}CH—CH_2—$, $—CH_2—C{=}C—CH_2—$, and xylylene. Examples of divalent aromatic groups of L include phenylene and naphthylene. These substituent groups can have further substituent group as described above.

M is preferably a metal ion or an organic cation. Examples of metal ions include a lithium ion, a sodium ion, and a potassium ion. Examples of organic cations include an ammonium ion (e.g., ammonium, tetramethylammonium, and tetrabutylammonium), a phosphonium ion (e.g. tetraphenylphosphonium), and a guanidyl group.

Examples of compounds represented by formulas (1) to (3) are listed in, but are not limited by, the following Table B.

TABLE B

| | | | |
|---|---|---|---|
| 1-1 | $CH_3SO_2SNa$ | 1-11 | $C_2H_5SO_2SNa$ |
| 1-2 | $C_3H_7SO_2SNa$ | 1-12 | $C_4H_9SO_2SK$ |

TABLE B-continued
| | | | |
|---|---|---|---|
| 1-3 | $C_5H_{11}SO_2SLi$ | 1-13 | $C_7H_{15}SO_2SNa$ |
| 1-4 | $C_4H_9-CH(C_3H_7)-SO_2SLi$ | 1-14 | $(C_2H_5)_2CH-SO_2SNa$ |
| 1-5 | $CH_2{=}CHCH_2SO_2SK$ | 1-15 | t-$C_4H_9SO_2SK$ |
| 1-6 | $HC{\equiv}C-CH_2SO_2SN$ | 1-16 | 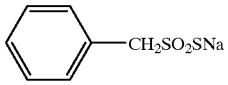 |
| 1-7 | 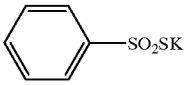 | 1-17 | 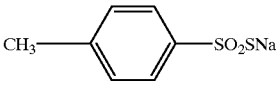 |
| 1-8 | 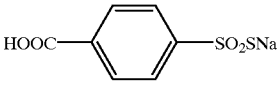 | 1-18 | 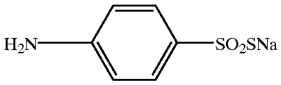 |
| 1-9 | 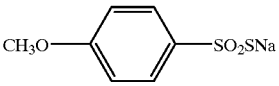 | 1-19 | 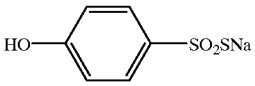 |
| 1-10 | 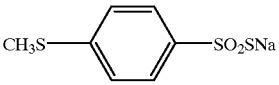 | 1-20 | 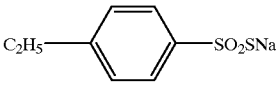 |
| 2-1 | $CH_3SO_2SCH_3$ | 2-2 | $C_2H_5SO_2SC_2H_5$ |
| 2-3 | $C_4H_9SO_2SC_4H_9$ | 2-4 | $C_4H_9SO_2SC_4H_8CN$ |
| 2-5 | 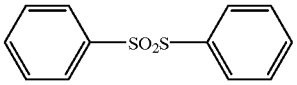 | 2-6 | 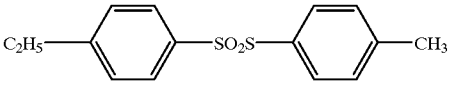 |
| 2-7 | 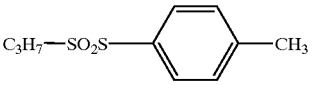 | 2-8 | 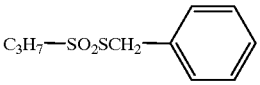 |
| 2-9 | 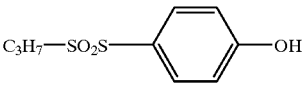 | 2-10 | 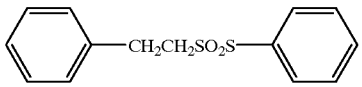 |
| 2-11 | $C_4H_9SO_2SC_2H_4COCH_3$ | 2-12 | $C_4H_9SO_2SCH_2OCOC_2H_5$ |
| 2-13 | $C_4H_9SO_2SCH_2-N(C_2H_5)_2$ | 2-14 | $C_4H_9SO_2SCH_2-N(CH_3)(C_2H_5)$ |
| 3-1 | $C_4H_9SO_2SC_2H_4SSO_2CH_3$ | 3-2 | $CH_3SO_2S(CH_2)_4SSO_2CH_3$ |
| 3-3 | 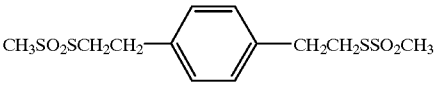 | 3-4 | 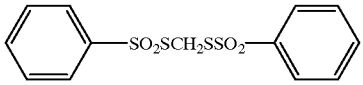 |
| 3-5 | 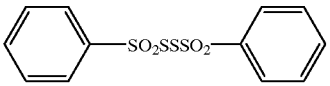 | 3-6 | $CH_3-SO_2SSSO_2-CH_3$ |

Compounds represented by formulas (1) to (3) can be easily synthetised by methods described or cited in JP-A-54-1019; British Patent 972,211; "Journal of Organic Chemistry", Vol. 53, PP. 396 (1988); and "Chemical Abstracts", Vol. 59, 9776e.

The thiosulfonic compounds represented by formulas (1) to (3) are preferably added in an amount of from $10^{-7}$ to $10^{-1}$ moles per mole of silver halide, more preferably from $10^{-5}$ to $10^{-2}$ moles per mole of silver halide, and still more preferably from $5\times10^{-2}$ to $5\times10^{-4}$ moles per mole of silver halide.

Reduction sensitization can be performed by any known reducing agent commonly employed in the photographic art, such as amine and polyamine, stannous salts, ascorbic acid and derivatives thereof, hydrazine derivatives, formamidinesulfinic acid and derivative thereof, silane compounds, and borane compounds.

The reduction sensitizer can be dissolved in the proper solvent (water or organic solvent, such as, ketones, esters, or amides) and then added to the silver halide emulsion. As mentioned above, the reduction sensitizer is added to the silver halide emulsion after the addition of the sulfuring agent and the stabilizer. Preferably, the reduction sensitizer is added to the silver halide emulsion after the end of the growing step.

More preferably, the reduction sensitization is performed by ascorbic acid and/or derivatives thereof. Examples of ascorbic acid and derivatives thereof are listed in, but are not limited to, the following Table C.

TABLE C

| | |
|---|---|
| A-1 | Sodium L-ascorbate |
| A-2 | Potassium L-ascorbate |
| A-3 | DL-ascorbic acid |
| A-4 | Sodium D-ascorbate |
| A-5 | L-ascorbic acid 6-acetate |
| A-6 | L-ascorbic acid 6-butyrate |
| A-7 | L-ascorbic acid 6-palmitate |
| A-8 | L-ascorbic acid 6-benzoate |
| A-9 | L-ascorbic acid 5,6-diacetate |

The ascorbic acid or a derivative thereof is added in amount of from $10^{-2}$ to 1 moles per mole of silver, preferably from $10^{-1}$ to 5×10−1 moles per mol of silver.

As mentioned above, the pAg of the emulsion during the addition of the sulfuring agent and stabilizer ranges from 6 to 14, more preferably from 8 to 12, and most preferably from 9 to 10. The pAg value can be adjusted by methods known in the art, such as addition of silver and halide soluble salts or addition of silver halide emulsion. The pAg value should be as much uniform as possible within the vessel solution. The vessel is provided with a proper mixing or stirring apparatus to assist in maintaining a uniform pAg. The variation of pAg value within the vessel should not exceed 0.1, preferably 0.01. According to a preferred embodiment of the present invention, a fine grain silver halide emulsion is added either between the addition of stabilizer and the addition of sulfuring agent or between the addition of sulfuring agent and the start of reduction sensitization or both.

The halide composition of the fine grain silver halide emulsion can be bromoiodide containing from 0.1 to 5 mol % of iodide or, preferably, pure silver bromide. The grain size of fine grain silver halide emulsion is less than 0.10 $\mu$m, preferably less than 0.06 $\mu$m, more preferably less than 0.04 $\mu$m. The total amount of fine grain silver halide emulsion added to the vessel is calculated so as to obtain an average shell thickness of from 20 to 500 Å, preferably from 50 to 300 Å, and more preferably from 50 to 200 Å. When the fine grain silver halide emulsion is added in two steps, as described above, the ratio between the first and second addition should range from 1:10 to 10:1, preferably from 1:5 to 5: 1, and more preferably from 1:2 to 2:1. The duration of the ripening time performed after each addition of fine grain silver halide emulsion depends on reagent concentrations, ripening temperature, and pBr and pH values. Practical ripening times range from 1 to 60 minutes, preferably from 5 to 30 minutes, and more preferably from 5 to 15 minutes.

Finally, water soluble salts are removed from the emulsion by procedures known in the art. Suitable cleaning arrangements are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

Among the known techniques for removing the dispersing medium and soluble salts while retaining silver halide grains in the remaining dispersion, ultrafiltration is a particularly advantageous cleaning arrangement for the practice of this process. Typically, an ultrafiltration unit comprising membranes of inert, non-ionic polymers is used as a cleaning arrangement. Since silver halide grains are large in comparison with the dispersing medium and the soluble salts or ions, silver halide grains are retained by said membranes while the dispersing medium and the soluble salts dissolved therein are removed.

Prior to use, the silver halide is generally fully dispersed and bulked up with gelatin or other dispersion of peptizer and subjected to any of the known methods for achieving optimum sensitivity.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. The silver halide emulsion is preferably chemically sensitized by at least one gold sensitizer and at least one sulfur sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at temperatures preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. It is also useful to increase the gold sensitization by using a thiocyanate together with the gold sensitizer, as described, for example, in T. H. James, *The Theory of the Photographic Process*, 4th edition, page 155, published by MacMillan Co, 1977. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Sulfur sensitization is preferably performed by adding a thiosulfonate sensitizer to the silver halide emulsion and stirring the emulsion at a high temperature of 40° C. or more for a predetermined period of time.

The amounts of the gold sensitizer and the sulfur sensitizer change in accordance with the various conditions, such as activity of the gold and sulfur sensitizer, type and size of silver halide grains, temperature, pH and time of chemical ripening. These amounts, however, are preferably from 1 to 20 mg of gold sensitizer per mol of silver, and from 1 to 100 mg of sulfur sensitizer per mol of silver. The temperature of chemical ripening is preferably 45° C. or more, and more preferably 50° C. to 80° C. The pAg and pH may take arbitrary values.

During chemical sensitization, addition times and order of gold sensitizer and sulfur sensitizer are not particularly limited. For example, gold and sulfur sensitizers can be added at the initial stage of chemical sensitization or at a later stage either simultaneously or at different times. Usually, gold and sulfur sensitizers are added to the silver halide emulsion by their solutions in water, in a water-miscible organic solvent, such as methanol, ethanol and acetone, or as a mixture thereof, The silver halide emulsions are preferably spectrally sensitized. Spectral sensitizing dyes having absorption maxima in the blue, minus blue (i.e., green and red) and infrared portions of the electromagnetic spectrum are particularly useful. Suitable spectral sensitizing dyes include polymethine dyes, such as cyanine and complex cyanine dyes, merocyanine and complex merocyanine dyes, as well as other dyes, such as oxonols, hemioxonols, styryls, merostyryls and streptocyanines as described by F. M. Hamer, *The Cyanine and Related Compounds*, Interscience Publishers. 1964.

Suitable cyanine dyes include, joined by a methine linkage, two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituents groups.

Suitable merocyanine dyes include, joined by a methine linkage, a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1–3-dione, and isoquinolin-4-one.

Preferred cyanine dyes are represented by the following formula:

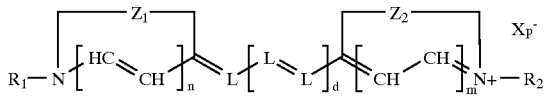

wherein n, m, p and d each independently represents 0 or 1, L represents a methine linkage, e.g., =CH—, =C($C_2H_5$), etc., $R_1$ and $R_2$ each represents a substituted or unsubstituted alkyl group, preferably a lower alkyl group of from 1 to 4 carbon atoms, e.g., methyl, ethyl, propyl, butyl, cyclohexyl and dodecyl, a hydroxyalkyl group, e.g., β-hydroxyethyl and Ω-hydroxybutyl, an alkoxyalkyl group, e.g., β-methoxyethyl and Ω-butoxyethyl, a carboxyalkyl group, e.g., β-carboxyethyl and Ω-carboxybutyl, a sulfoalkyl group, e.g., β-sulfoethyl and Ω-sulfobutyl, a sulfatoalkyl group, e.g., β-sulfatoethyl and Ω-sulfatobutyl, an acyloxyalkyl group, e.g., β-acetoxyethyl, γ-acetoxypropyl and Ω-butyryloxybutyl, an alkoxycarbonylalkyl group, e.g., β-methoxycarbonylethyl and Ω-ethoxycarbonylbutyl, benzyl, phenethyl, or an aryl group of up to 30 carbon atoms, e.g., phenyl, tolyl, xylyl, chlorophenyl and naphthyl, X represents an acid anion, e.g., chloride, bromide, iodide, thiocyanate, sulfate, perchlorate, p-toluenesulfonate and methylsulfate, said methine linkage forming an intramolecular salt when p is 0; Z1 and Z2, the same or different, each represents the non metallic atoms necessary to complete the same simple or condensed 5- or 6-membered heterocyclic nucleus, such as a benzothiazole nucleus (e.g., benzothiazole, 3-, 5-, 6- or 7-chloro-benzothiazole, 4-, 5- or 6-methylbenzothiazole, 5- or 6-bromobenzothiazole, 4- or 5-phenyl-benzothiazole, 4-, 5- or 6-methoxybenzothiazole, 5,6-dimethyl-benzothiazole and 5- or 6-hydroxybenzothiazole), a naphthothiazole nucleus (e.g., α-naphthothiazole, β-naphthothiazole, 5-methoxy-β-naphthothiazole, 5-ethoxy-α-naphthothiazole and 8-methoxy-α-naphthothiazole), a benzoselenazole nucleus (e.g., benzoselenazole, 5-chloro-benzoselenazole and tetrahydrobenzoselenazole), a naphthoselenazole nucleus (e.g., α-naphtho-selenazole and β-naphthoselenazole), a benzoxazole nucleus (e.g., benzoxazole, 5- or 6-hydroxybenzoxazole, 5-chloro-benzoxazole, 5- or 6-methoxybenzoxazole, 5-phenyl-benzoxazole and 5,6-dimethylbenzoxazole), a naphthoxazole nucleus (e.g., α-naphthoxazole and β-naphthoxazole), a 2-quinoline nucleus (e.g., 2-quinoline, 6-, 7, or 8-methyl-2-quinoline, 4-, 6- or 8-chloro-2-quinoline, 5-, 6- or 7-ethoxy-2-quinoline and 6- or 7-hydroxy-2-quinoline), a 4-quinoline nucleus (e.g., 4-quinoline, 7- or 8-methyl-4-quinoline and 6-methoxy-4-quinoline), a benzimidazole nucleus (e.g., benzimidazole, 5-chloro-benzimidazole and 5,6-dichlorobenzimidazole), a thiazole nucleus (e.g., 4- or 5-methylthiazole, 5-phenyl-thiazole and 4,5-di-methyl-thiazole), an oxazole nucleus (e.g., 4- or 5-methyl-oxazole, 4-phenyloxazole, 4-ethyl-oxazole and 4,5-dimethyl-oxazole), and a selenazole nucleus (e.g., 4-methyl-selenazole and 4-phenylselenazole. More preferred dyes within the above class are those having an internal salt group and/or derived from benzoxazole and benzimidazole nuclei as indicated before. Typical methine spectral sensitizing dyes include those listed below.

Dye A

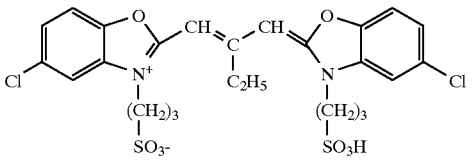

Dye B

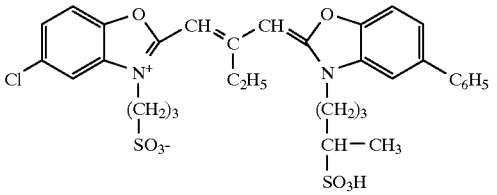

-continued

Dye C

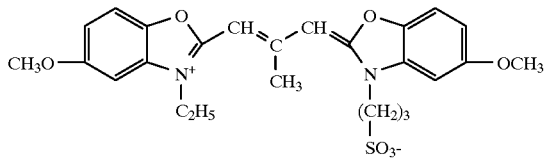

Dye D

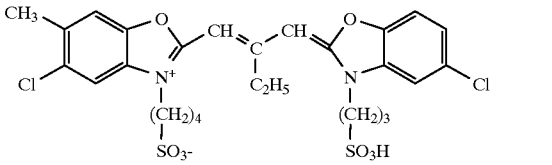

Dye E

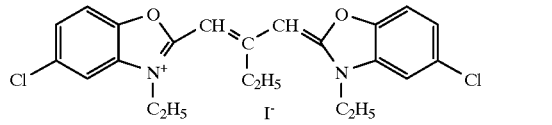

Dye F

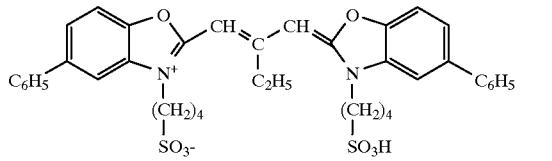

Dye G

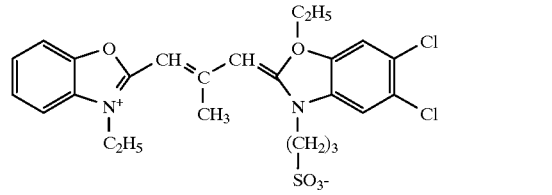

Methine spectral sensitizing dyes are generally known in the art. Particular reference can be made to U.S. Pat. Nos. 2,503,776; 2,912,329; 3,148,187; 3,397,060; 3,573,916 and 3,822,136 and FR Patent No. 1,118,778. Also their use in photographic emulsions is known wherein they are used in optimum concentrations corresponding to desired values of sensitivity to fog ratios. Optimum or near optimum concentrations of spectral sensitizing dyes generally go from 10 to 500 mg per mol of silver, preferably from 50 to 200, more preferably from 50 to 100.

Spectral sensitizing dyes can be used in combinations resulting in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, *Photographic Science and Engineering*, 18, pp. 418–430, 1974 and in U.S. Pat. Nos. 2,933,390; 3,635,721; 3,743,510; 3,615,613; 3,615,641; 3,617,295 and 3,635,721, Preferably, spectral sensitizing dyes are used in supersensitizing combination with polymeric compounds containing an aminoallylidenemalonnitrile (>N—CH═CH—CH═$(CN)_2$) moiety, such as those described in U.S. Pat. No. 4,307,183. Said polymeric compounds are preferably obtained upon copolymerization of an allyl monomer which has an ethylenically condensed amionoallyidenemalononitrile moiety (such as diallylaminoallylidenemalononitile monomer) with an ethtylenically unsaturated monomer, the monomer being preferably a water-soluble monomer; the copolymerization being preferably a solution polymerization, the polymeric compound being preferably a water-soluble polymer; the monomer more preferably being an acrylic or methacrylic monomer, most preferably being acrylamide or acrylic acid.

Examples of polymeric compounds which can be used in supersensitizing combination with spectral sensitizing dyes are preferably the polymeric compounds described in the following table D wherein the monomer is copolymerized (in solution in the presence of a polymerization initiator) with a diallylaminoallylidenemalononitrile monomer, as well as a weight percent quantity of aminoallylidenemalononitrile moieties (AAMN) within the polymers themeselves are indicated.

TABLE D

| Compound | Monomer | % AAMN |
|---|---|---|
| 1 | Acrylamide | 9 |
| 2 | Methacrylic acid | 11 |
| 3 | Acrylamide | 10,5 |
| 4 | Acrylic acid | 23 |
| 5 | Acrylamide | 44 |
| 6 | Vinylpirrolidone | 44 |
| 7 | Vinyloxazolidone | 14,5 |
| 8 | Vinyloxazolidone | 37 |
| 9 | Methacrylamide | 8 |
| 10 | Acrylamide-Allylamide,HCl | 10 |
| 11 | Acrylamide-Diallylamide,HCl | 7 |

Methods of preperation of the polymeric compounds are described in U.S. Pat. No. 4,307,183. The optimum concentrations of the polymeric compounds generally go from 10 to 1,000 mg per mol of silver, preferably from 50 to 500, more preferably from 150 to 350, the weight ratio of the polymeric compound to the spectral sensitizing dye normally being of 10/1 to 1/10, preferably 5/1 to 1/5, more preferably 2,5/1 to 1/1 (such a ratio of course depending upon the aminoallylidenemalononitrile moiety content of the polymeric compound: the higher such content, the lower such ratio).

Spectral sensitization can be performed at any stage of silver halide preparation. It can be performed subsequent to the completion of chemical sensitization or concurrently with chemical sensitization, or can precede chemical sensitization, or even can commence prior to the completion of silver halide precipitation. In the preferred form, spectral sensitizing dyes can be incorporated in the silver halide emulsions prior to chemical sensitization.

The silver halide emulsions are useful in light-sensitive photographic elements. A light-sensitive silver halide photographic element can be prepared by coating the above described silver halide emulsion on a photographic support. There is no limitation with respect to the support. Examples of suitable support materials include glass, paper, polyethylene-coated paper, metals, cellulose nitrate, cellulose acetate, polystyrene, polyesters such as polyethylene terephthalate, polyethylene, polypropylene and other well known supports.

The light-sensitive silver halide photographic element specifically is applicable to light-sensitive photographic color elements such as color negative films, color reversal films, color papers, etc., as well as black-and-white light-sensitive photographic elements such as X-ray light-sensitive elements, lithographic light-sensitive elements, black-and-white photographic printing papers, black-and-white negative films, etc.

Preferred light-sensitive silver halide photographic elements are X-ray light-sensitive elements comprising the above described silver halide emulsion coated on one surface, preferably on both surfaces of a polyethylene terephthalate support. Preferably, the silver halide emulsion is coated on the support at a total silver coverage in the range of 3 to 6 grams per square meter. Usually, the X-ray light-sensitive elements are associated with intensifying screens so as to be exposed to radiation emitted by the screens. The screens are made of relatively thick phosphor layers which transform the X-rays into light radiation (e.g., visible light). The screens absorb a portion of X-rays much larger than the light-sensitive element and are used to reduce the X-ray dose necessary to obtain a useful image. According to their chemical composition, the phosphors can emit radiation in the blue, green or red region of the visible spectrum and the silver halide emulsions are sensitized to the wavelength region of the light emitted by the screens. Sensitization is performed by using spectral sensitizing dyes adsorbed on the surface of the silver halide grains as known in the art.

The exposed light-sensitive elements can be processed by any of the conventional processing techniques. The processing can be a black-and-white photographic processing for forming a silver image or a color photographic processing for forming a dye image depending upon the purpose. Such processing techniques are illustrated for example in Research Disclosure, 17643. December 1978. Roller transport processing in an automatic processor is particularly preferred, as illustrated in U.S. Pat. Nos. 3,025,779, 3,515,556, 3,545,971 and 3,647,459 and in UK Pat. No. 1,269,268. Hardening development can be undertaken, as illustrated in U.S. Pat. No. 3,232,761.

The light sensitive layer containing the silver halide emulsion obtained with the method of this invention can contain other constituents generally used in photographic products, such as binders, hardeners, surfactants, speed-increasing agents, stabilizers, plasticizers, optical sensitizers, dyes, ultraviolet absorbers, etc., and reference to such constituents can be found, for example, in Research Disclosure, Vol. 176 (December 1978), pp. 22–28.

The light-sensitive element comprising the silver halide emulsion obtained with the process of the present invention shows an increase of speed and average contrast together with a reduction of Dmin (also known in the art as fog). The light-sensitive element also shows a better storage stability, which allows to obtain a longer useful life of the marketed product. More in particular, a light-sensitive element comprising the silver halide emulsion obtained with the process of the present invention shows a Dmin and speed variation lower than 10%, preferably lower than 5% when stored for 5 days at 50° C. and 60% of relative humidity.

The present invention is now illustrated by reference to the following examples, which are not intended to limit the scope of the invention.

EXAMPLE 1

Sample 1 (comparison)

A silver bromoiodide tabular emulsion 1 comprising less than 0.9% mol of iodide was prepared according to the following method, An aqueous gelatin solution consisting of 4000 ml of water, 32 g of deionized gelatin, and 24 g of potassium bromide was put in a 10 liter reaction vessel. The temperature was raised to 55° C. and the pBr was adjusted at 1.3.

Nucleation: A 2N silver nitrate aqueous solution and a 2N potassium bromide aqueous solution were added by double jet technique over a period of 125 seconds at a constant flow rate of 23 and 45.5 ml/min, respectively, while keeping the temperature constant at 56° C. Then, the temperature was raised from 55° C. to 58° C. during 150 seconds and a 2N silver nitrate aqueous solution was added by single jet technique over a period of 22 minutes at a constant flow rate of 5.2 ml/min, while raising the temperature from 58° C. to 70° C. At the end of the silver nitrate addition, 35 ml of a 12N ammonium hydroxide aqueous solution were added and the resulting solution was ripened for 10 minutes. The pH was adjusted with 26 ml of glacial acetic acid.

Growth: A 2N silver nitrate aqueous solution and a 2N potassium bromide aqueous solution were added to the vessel over a period of 40 minutes by accelerated double jet method, with a linear addition ramp rising from 10.00 ml/min to 65 ml/min. After that, a 2N silver nitrate aqueous solution and a potassium iodobromide aqueous solution (Br=1.94N, I=0.04 N) were further added to the vessel over a period of 22 minutes by accelerated double jet method, with a linear addition ramp rising from 33.00 ml/min to 55.00 ml/min.

Washing: The resulting emulsion was subjected to a conventional method of ultrafiltration and washing and added with a gelatin aqueous solution containing 345 g of water and 345 g of gelatin.

The resulting emulsion had a mean grain size of 1.33 $\mu$m and an average grain thickness of 0.22 $\mu$m, so obtaining an average aspect ratio of about 5.9. The emulsion had a coefficient of variation (COV) of about 37%. The term coefficient of variation is known in the art as the percentage ratio of the standard deviation of all silver halide grain diameters divided by the average silver halide grain diameters.

Prior to start the chemical digest, the emulsion silver concentration was first adjusted to 17%, the pH is corrected to 6.5 and the pAg to 8.4.

The emulsion was chemically and spectrally sensitized with a conventional sulfur-gold sensitization process while keeping the temperature a 60° C. The following amounts are referred to one mole of silver, The emulsion was added with 4.19 mmoles of potassium thiocyanate, 1.48 mmoles of gold chloride, $7.16\times10^{-4}$ mmoles of mercuric chloride, 0.162 mmoles of zinc sulfate eptaidrate, $5.5\times10^{-3}$ mmoles of potassium hexachloropalladate, 0.594 mmoles 5-methyl-7-hydroxy-2-3-4-triazoindolizine (4-hydroxy-6-methyl-1,3,3a,7-tetraazaindene), 0.8 mmoles of triethyl ammonium salt of 5,5'-dichloro-9-ethyl-3,3'-di-(3-sulfopropyl) oxacarbocyanine as spectral sensitization dye, and $5.15\times10^{-2}$ mmoles of sodium thiosulfate.

The total digestion time was performed during about 95 minutes at 50° and stabilized successively with 2.17 mmole/Agmole of potassium iodide and 15.65 mmoles/Agmole of 5-methyl-7-hydroxy-2-3-4-triazoindolizine (4-hydroxy-6-methyl-1,3,3a,7-tetraazaindene) first to be chilled.

Sample 2 (comparison)

A silver bromoiodide tabular emulsion 2 comprising less than 0.9% mol of iodide was prepared according to the method of Sample 1, but 1.6 mmoles of triethyl ammonium salt of 5,5'-dichloro-9-ethyl-3,3'-di-(3-sulfopropyl) oxacarbocyanine were used.

Sample 3 (comparison)

A silver bromoiodide tabular emulsion 3 comprising less than 0.9% mol of iodide was prepared according to the method of Sample 1, but 2.4 mmoles of triethyl ammonium salt of 5,5'-dichloro-9-ethyl-3,3'-di-(3-sulfopropyl) oxacarbocyanine were used.

Sample 4 (comparison)

A silver bromoiodide tabular emulsion 4 comprising less than 0.9% mol of iodide was prepared according to the method of Sample 1, but $1.22\times10^{-3}$ mol/mol Ag of 4-hydroxy-6-methyl-1,3,3a,7-tetraazaindene, $1.56\times10^{-4}$ mol/mol Ag of sodium p-methyl-toluenethiosulfonate and 0.164 mol/mol Ag of ascorbic acid were introduced after five minutes from the start of the second double jet growth addition.

Sample 5 (comparison)

A silver bromoiodide tabular emulsion 5 comprising less than 0.9% mol of iodide was prepared according to the method of Sample 2, but the following steps were added between the growth and washing steps.

a. Addition of $1.56\times10^{-4}$ mol/mol Ag of sodium p-methyltoluenethiosulfonate
b. Addition of 0.018 mol Ag/mol Ag of silver bromide Lippmann emulsion having grain size of 0.04 μm.
c. Digestion for 15 min at 70° C.
d. Addition of 0.023 mol Ag/mol Ag of silver bromide Lippmann emulsion having grain size of 0.04 μm.
e. Addition Of 0.164 mol/mol Ag of ascorbic acid.
f. Digestion for 15 min at 70° C.

The pAg of the emulsion was about 9.5.

Sample 6 (invention)

A silver bromoiodide tabular emulsion 6 comprising less than 0.9% mol of iodide was prepared according to the method of Sample 1, but the following steps were added between the growth and washing steps.

a. Addition of $1.22\times10^{-3}$ mol/mol Ag of 4-hydroxy-6-methyl- 1,3,3a,7-tetraazaindene
b. Addition of 0.018 mol Ag/mol Ag of silver bromide Lippmann emulsion having grain size of 0.04 μm.
c. Addition of $1.56\times10^{-4}$ mol/mol Ag of sodium p-methyltoluenethiosulfonate
d. Digestion for 15 min at 70° C.
e. Addition of 0.023 mol Ag/mol Ag of silver bromide Lippmann emulsion having grain size of 0.04 μm.
f. Addition of 0.164 mol/mol Ag of ascorbic acid.
g. Digestion for 15 min at 70° C.

The pAg of the emulsion was about 9.5.

Sample 7 (invention)

A silver bromoiodide tabular emulsion 7 comprising less than 0.9% mol of iodide was prepared according to the method of Sample 2, but the following steps were added between the growth and washing steps.

a. Addition of $1.22\times10^{-3}$ mol/mol Ag of 4-hydroxy-6-methyl-1,3,3a,7-tetraazaindene
b. Addition of 0.018 mol Ag/mol Ag of silver bromide Lippmann emulsion having grain size of 0.04 μm.
c. Addition of $1.56\times10^{-4}$ mol/mol Ag of sodium p-methyltoluenethiosulfonate
d. Digestion for 15 min at 70° C.
e. Addition of 0.023 mol Ag/mol Ag of silver bromide Lippmann emulsion having grain size of 0.04 μm.
f. Addition of 0.164 mol/mol Ag of ascorbic acid.
g. Digestion for 15 min at 70° C.

The pAg of the emulsion was about 9.5.

Sample 8 (invention)

A silver bromoiodide tabular emulsion 8 comprising less than 0.9% mol of iodide was prepared according to the method of Sample 3, but the following steps were added between the growth and washing steps.

a. Addition of $1.22\times10^{-3}$ mol/mol Ag of 4-hydroxy-6-methyl-1,3,3a,7-tetraazaindene
b. Addition of 0.018 mol Ag/mol Ag of silver bromide Lippmann emulsion having grain size of 0.04 μm.
c. Addition of $1.56\times10^{-4}$ mol/mol Ag of sodium p-methyltoluenethiosulfonate
d. Digestion for 15 min at 70° C.
e. Addition of 0.023 mol Ag/mol Ag of silver bromide Lippmann emulsion having grain size of 0.04 μm.
f. Addition of 0.164 mol/mol Ag of ascorbic acid.
g. Digestion for 15 min at 70° C.

The pAg of the emulsion was about 9.5.

Sample 9 (invention)

A silver bromoiodide tabular emulsion 9 comprising less than 0.9% mol of iodide was prepared according to the method of Sample 2, but the following steps were added between the growth and washing steps.

a. Addition of $1.22\times10^{-3}$ mol/mol Ag of 4-hydroxy-6-methyl-1,3,3a,7-tetraazaindene
b. Addition of 0.018 mol Ag/mol Ag of silver bromide Lippmann emulsion having grain size of 0.04 μm.
c. Addition of $1.56\times10^{-4}$ mol/mol Ag of sodium p-methyltoluenethiosulfonate
d. Digestion for 10 min at 70° C.
e. Addition of 0.023 mol Ag/mol Ag of silver bromide Lippmann emulsion having grain size of 0.04 μm.
f. Addition of 0.164 mol/mol Ag of ascorbic acid.
g. Digestion for 10 min at 70° C.

The pAg of the emulsion was about 9.5.

The resulting silver halide emulsions 1 to 9 were immediately coated on a two faces of blue 7 mil polyester support at a coating weight of 2.25 $gAg/M^2$ per face. An antistatic top-coat as described in EP 633,496 was provided on both emulsion layers, so obtaining a radiographic film samples 1 to 9. The fresh film samples were kept 3 days at 38° C. before being subjected to X-ray exposure using a Comet X-ray exaphase tungsten tube at 75 KVp for 0.06 sec with two Imation Trimax™ T8 type screens. The film was then processed with Imation standard chemistry (XAD-3 developer and XAF-3 fixer) in a Imation XP-515 automatic developer at 34° C. Development and fixing times were 25 and 27 seconds, respectively. The sensitometric results are reported in the following Table 1. Composition of XAD-3 developer and XAF-3 fixer can be found in Table 2 and 3.

TABLE 1

| Sample | Fresh Sensitometry after 3 days at 38° C. | | | | Sensitometry after 5 days at 50° C. and 60% RH | | | |
|---|---|---|---|---|---|---|---|---|
| | Relative Speed | Dmin | Mean Contrast | Dmax | Relative Speed | Dmin | Mean Contrast | Dmax |
| 1 (Comp) | 100 | 0.19 | 2.40 | 3.87 | 89 | 0.20 | 2.36 | 3.77 |
| 2 (Comp) | 102 | 0.21 | 2.50 | 3.80 | 96 | 0.24 | 2.25 | 3.68 |
| 3 (Comp) | 103 | 0.23 | 2.42 | 3.82 | 92 | 0.26 | 2.31 | 3.73 |
| 4 (Comp) | 55 | 0.60 | 1.60 | 3.75 | — | — | — | — |
| 5 (Comp) | 100 | 0.20 | 2.78 | 3.60 | 90 | 0.26 | 2.70 | 3.55 |
| 6 (Inv.) | 100 | 0.17 | 2.80 | 3.88 | 100 | 0.18 | 2.60 | 3.80 |
| 7 (Inv.) | 130 | 0.17 | 2.90 | 3.92 | 125 | 0.18 | 2.60 | 3.75 |
| 8 (Inv.) | 140 | 0.18 | 2.84 | 3.80 | 135 | 0.19 | 2.64 | 3.70 |
| 9 (Inv.) | 115 | 0.18 | 2.96 | 3.57 | 123 | 0.18 | 3.00 | 3.65 |

The data of Table 1 clearly show the improvement in Dmin values, in particular under accelerated aging, and in speed of samples 6 through 9 of the present invention.

EXAMPLE 2

Sample 10 (invention)

A silver bromoiodide tabular emulsion 10 comprising less than 0.9% mol of iodide was prepared according to the method of Sample 6, but the total digestion time was reduced from 95 to 75 minutes.

Sample 11 (invention)

A silver bromoiodide tabular emulsion 11 comprising less than 0.9% mol of iodide was prepared according to the method of Sample 6.

Sample 12 (comparison)

A silver bromoiodide tabular emulsion 12 comprising less than 0.9% mol of iodide was prepared according to the method of Sample 6, but the total digestion time was reduced from 95 to 70 minutes and the amount of ascorbic acid was reduced to $1.64\times10^{-5}$ mmoles per mole of Ag.

Sample 13 (comparison)

A silver bromoiodide tabular emulsion 13 comprising less than 0.9% mol of iodide was prepared according to the method of Sample 6, but the total digestion time was reduced from 95 to 90 minutes and the amount of ascorbic acid was reduced to $1.64\times10^{-5}$ mmoles per mole of Ag.

The resulting silver halide emulsions 10 to 13 were coated, exposed and processed as described for Example 1. The sensitometric results are reported in the following Table 2.

TABLE 2

| Sample | Relative Speed | Dmin | Mean Contrast | Dmax |
|---|---|---|---|---|
| 11 (Inv.) | 100 | 0.17 | 2.81 | 3.66 |
| 12 (Inv.) | 102 | 0.18 | 2.81 | 3.60 |
| 13 (Comp) | 94 | 0.17 | 1.56 | 2.89 |
| 14 (Comp) | 100 | 0.18 | 1.95 | 3.23 |

The data of Table 2 show that the reduction of the amount of ascorbic acid negatively affect the performance of the resulting sample in terms of speed and contrast.

| DEVELOPER | | FIXER | |
|---|---|---|---|
| Water | 800 g | $(NH_4)_2S_2O_3$ | 145.2 g |
| $Na_2S_2O_5$ | 45 g | $Na_2SO_3$ | 8.12 g |
| KOH 35% (w/w) | 105 g | Boric Acid | 7.00 g |
| $K_2CO_3$ | 13.25 g | $CH_3COOH$ | 7.52 g |
| $CH_3COOH$ | 7.6 g | KI | 0.05 g |
| Ethyleneglycol | 10 g | $CH_3COONH_4$ | 19.24 g |
| Diethyleneglycol | 4.9 g | $Al_2(SO_4)_3$ | 7.74 g |
| Glutaraldehyde 50% (w/w) | 7.2 g | $H_2SO_4$ 100% (w/w) | 3.58 g |
| EDTA.4Na | 1.5 g | Water to make | 1 liter |
| BUDEX 5103.2Na 40% (w/w) | 7.5 g | pH at 20° C. | 4.30 |
| Boric acid | 1.7 g | | |
| 5-methyl-benzotriazole | 0.08 g | | |
| 5-nitro-indazole | 0.107 g | | |
| 1-phenyl-1-H-tetrazole-5-thiol | 0.007 g | | |
| Hydroquinone | 20 g | | |
| Phenidone | 1.45 g | | |
| Sodium bromide | 5 g | | |
| Water to make | 1 liter | | |
| pH at 20° C. | 10.35 | | |

What is claimed is:

1. A method for manufacturing a silver halide photographic emulsion comprising a nucleation step, a growing step and a washing step, wherein a reduction sensitization is performed in the presence of a sulfuring agent and a stabilizer and further wherein the reduction sensitization occurs between the growing step and the washing step.

2. The method according to claim 1, wherein said stabilizer is an azaindene derivative.

3. The method according to claim 1, wherein said stabilizer is a tetraazaindene derivative.

4. The method according to claim 1, wherein said stabilizer is added in amount of from $10^{-6}$ to $10^{-1}$ mol per mole of silver.

5. The method according to claim 1, wherein said stabilizer is added in amount of from $10^{-4}$ to $10^{-2}$ mol per mole of silver.

6. The method according to claim 1, wherein said reduction sensitization is performed by ascorbic acid or a derivative thereof.

7. The method according to claim 6, wherein said ascorbic acid or a derivative thereof is added in amount of from $10^{-2}$ to 1 mol per mole of silver.

8. The method according to claim 6, wherein said ascorbic acid or a derivative thereof is added in amount of at least $10^{-1}$ mol per mole of silver.

9. The method according to claim 1, wherein said sulfuring agent is thiosulfonic acid or a derivative thereof.

10. The method according to claim 1, wherein said sulfuring agent is selected from the group consisting of compounds represented by the following formulas (1), (2) and (3):

$$R—SO_2S—M \quad (1)$$

$$R—SO_2S—R^1 \quad (2)$$

$$R—SO_2S—L_m—SSO_2—R^2 \quad (3)$$

wherein R, $R^1$, and $R^2$, each equal or different, represents an aliphatic group, an aromatic group, or a heterocyclic group, M represents a cation, L represents an organic divalent linking group, m is 0 or 1.

11. The method according to claim 1, wherein said reduction sensitization is performed at a pAg value of from 6 to 14.

12. The method according to claim 11, wherein a fine grain silver halide emulsion is added between the addition of stabilizer and the addition of sulfuring agent.

13. The method according to claim 11, wherein a fine grain silver halide emulsion is added between the addition of sulfuring agent and the start of reduction sensitization.

14. The method according to claim 11, wherein a fine grain silver halide emulsion is added both between the addition of sulfur ng agent and the start of reduction sensitization and between the addition of stabilizer and the addition of sulfuring agent.

15. The method according to claim 12, wherein said fine grain silver halide emulsion is selected from the group consisting of silver bromoiodide emulsion containing from 0.1 to 5 mol % of iodide and pure silver bromide emulsion.

16. The method according to claim 12, wherein said fine grain silver halide emulsion has a grain size lower than 0.10 μm.

17. The method according to claims 12, wherein said fine grain silver halide emulsion is added in an amount such as to obtain an average shell thickness of from 20 to 500 Å.

18. The method according to claim 13, wherein said fine grain silver halide emulsion is selected from the group consisting of silver bromoiodide emulsion containing from 0.1 to 5 mol % of iodide and pure silver bromide emulsion.

19. The method according to claim 13, wherein said fine grain silver halide emulsion has a grain size lower than 0.10 μm.

20. The method according to claims 13, wherein said fine grain silver halide emulsion is added in an amount such as to obtain an average shell thickness of from 20 to 500 Å.

21. The method according to claim 14, wherein the weight ratio between the first and second addition of fine grain silver halide emulsion ranges from 1:10 to 10:1.

22. A silver halide radiographic element comprising a support and at least one silver halide emulsion layer coated on both sides thereof, wherein said silver halide emulsion layer comprises a silver halide emulsion manufactured according to the method of claim 1, and wherein said silver halide radiographic element shows a Dmin and speed variation lower than 10% when stored for 5 days at 50° C. and 60% relative humidity.

23. The method of claim 1 wherein the reduction sensitization is conducted between the end of the growing step and the start of the washing step.

24. The method of claim 1 further comprising a ripening step.

* * * * *